US009388758B2

(12) United States Patent
Pochner et al.

(10) Patent No.: US 9,388,758 B2
(45) Date of Patent: Jul. 12, 2016

(54) MODEL PREDICTIVE CONTROL SYSTEMS AND METHODS FOR FUTURE TORQUE CHANGES

(71) Applicant: GM Global Technology Operations LLC, Detroit, MI (US)

(72) Inventors: Klaus Pochner, Novi, MI (US); Christopher E. Whitney, Commerce, MI (US); Gary Robert Cygan, Jr., Auburn Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 240 days.

(21) Appl. No.: 14/226,006

(22) Filed: Mar. 26, 2014

(65) Prior Publication Data

US 2015/0275796 A1 Oct. 1, 2015

(51) Int. Cl.
*F02D 41/00* (2006.01)
*F02D 41/04* (2006.01)
(Continued)

(52) U.S. Cl.
CPC ..... *F02D 41/04* (2013.01); *F02D 37/02* (2013.01); *F02D 41/1401* (2013.01); *F02D 41/1497* (2013.01); *F02D 41/005* (2013.01); *F02D 41/0007* (2013.01); *F02D 41/023* (2013.01); *F02D 2041/001* (2013.01); *F02D 2041/1412* (2013.01); *F02D 2041/1433* (2013.01);
(Continued)

(58) Field of Classification Search
CPC . Y02T 10/6291; F02D 41/00; F02D 41/2429; F02D 41/2451; F02D 41/04; F02D 41/1497; F02D 37/02; F02D 41/1401; F02D 41/005; F02D 2200/025; F02D 2041/1433; F02D 41/023; F02D 41/0007; F02D 2041/1412; F02D 2200/602; F02D 2200/0611; F02N 2300/2006
USPC ..... 701/101, 102, 103, 104, 105, 106, 110, 701/111, 113, 114, 115
See application file for complete search history.

(56) References Cited

U.S. PATENT DOCUMENTS 4,161,929 A 7/1979 Nohira et al.
5,070,846 A * 12/1991 Dudek ..... F02D 41/045 123/488
(Continued)

FOREIGN PATENT DOCUMENTS

CN 1594846 A 3/2005
WO WO-03-065135 A1 8/2003

OTHER PUBLICATIONS

U.S. Appl. No. 14/675,828, filed Apr. 1, 2015, Long et al.
(Continued)

*Primary Examiner* — Hai Huynh
*Assistant Examiner* — Raza Najmuddin

(57) ABSTRACT

A prediction module, based on a set of possible target values for M future times and a model of an engine, determines predicted torques of the engine for the M future times, respectively. M is an integer greater than one. A cost module determines a cost for the set of possible target values based on comparisons of the predicted torques for the M future times with engine torque requests for the M future times, respectively. A selection module, based on the cost, selects the set of possible target values from a group including the set of possible target values and N other sets of possible target values, wherein N is an integer greater than zero, and sets target values based on the selected set of possible target values. An actuator module controls an engine actuator based on a first one of the target values.

20 Claims, 4 Drawing Sheets

(51) Int. Cl.

| | |
|---|---|
| ***F02D 41/14*** | (2006.01) |
| ***F02D 37/02*** | (2006.01) |
| *F02D 41/02* | (2006.01) |
| *F02P 5/15* | (2006.01) |

(52) U.S. Cl.

CPC ... *F02D2200/025* (2013.01); *F02D 2200/0611* (2013.01); *F02D 2200/1004* (2013.01); *F02D 2200/602* (2013.01); *F02D 2200/606* (2013.01); *F02D 2250/18* (2013.01); *F02N 2300/2006* (2013.01); *F02P 5/1502* (2013.01)

(56) References Cited

U.S. PATENT DOCUMENTS 5,101,786 A 4/1992 Kamio et al.
5,293,553 A * 3/1994 Dudek ..... F02D 41/1401 123/480
5,706,780 A 1/1998 Shirakawa
5,727,528 A 3/1998 Hori et al.
5,775,293 A 7/1998 Kresse
5,921,219 A 7/1999 Frohlich et al.
6,014,955 A 1/2000 Hosotani et al.
6,155,230 A 12/2000 Iwano et al.
6,532,935 B2 3/2003 Ganser et al.
6,606,981 B2 8/2003 Itoyama
6,704,638 B2 3/2004 Livshiz et al.
6,714,852 B1 * 3/2004 Lorenz ..... F02B 77/085 701/102
6,826,904 B2 12/2004 Miura
6,840,215 B1 1/2005 Livshiz et al.
6,985,809 B2 * 1/2006 Yasui ..... F02D 41/0235 123/672
7,016,779 B2 3/2006 Bowyer
7,021,282 B1 4/2006 Livshiz et al.
7,051,058 B2 5/2006 Wagner et al.
7,274,986 B1 9/2007 Petridis et al.
7,395,147 B2 7/2008 Livshiz et al.
7,400,967 B2 7/2008 Ueno et al.
7,433,775 B2 10/2008 Livshiz et al.
7,441,544 B2 10/2008 Hagari
7,614,384 B2 11/2009 Livshiz et al.
7,703,439 B2 4/2010 Russell et al.
7,715,975 B2 5/2010 Yamaoka et al.
7,775,195 B2 8/2010 Schondorf et al.
7,813,869 B2 10/2010 Grichnik et al.
7,885,756 B2 2/2011 Livshiz et al.
7,941,260 B2 5/2011 Lee et al.
7,967,720 B2 6/2011 Martin et al.
8,041,487 B2 10/2011 Worthing et al.
8,050,841 B2 11/2011 Costin et al.
8,073,610 B2 12/2011 Heap et al.
8,103,425 B2 1/2012 Choi et al.
8,103,428 B2 1/2012 Russ et al.
8,116,954 B2 2/2012 Livshiz et al.
8,176,735 B2 5/2012 Komatsu
8,307,814 B2 11/2012 Leroy et al.
8,447,492 B2 5/2013 Watanabe et al.
8,468,821 B2 6/2013 Liu et al.
8,483,935 B2 7/2013 Whitney et al.
8,739,766 B2 6/2014 Jentz et al.
8,862,248 B2 10/2014 Yasui
8,954,257 B2 2/2015 Livshiz et al.
9,052,997 B2 * 6/2015 Ono ..... G06F 17/00
9,062,631 B2 6/2015 Kinugawa et al.
9,075,406 B2 7/2015 Nakada
9,145,841 B2 9/2015 Miyazaki et al.
9,175,628 B2 11/2015 Livshiz et al.
2002/0038647 A1 4/2002 Tashiro et al.
2003/0074892 A1 4/2003 Miura
2003/0110760 A1 6/2003 Shirakawa
2003/0145836 A1 8/2003 Linna et al.
2004/0116220 A1 6/2004 Yamamoto et al.
2005/0065691 A1 3/2005 Cho
2005/0131620 A1 6/2005 Bowyer
2005/0171670 A1 8/2005 Yoshioka et al.
2005/0193739 A1 * 9/2005 Brunell ..... G05B 13/048 60/772
2005/0267608 A1 * 12/2005 Nishira ..... B60K 31/0008 700/44
2006/0199699 A1 9/2006 Berglund et al.
2007/0068159 A1 * 3/2007 Ueno ..... F02D 23/00 60/605.2
2007/0174003 A1 7/2007 Ueno et al.
2008/0271718 A1 11/2008 Schondorf et al.
2008/0308066 A1 12/2008 Martin et al.
2009/0018733 A1 1/2009 Livshiz et al.
2009/0033264 A1 2/2009 Falkenstein
2009/0037066 A1 2/2009 Kuwahara et al.
2009/0037073 A1 2/2009 Jung et al.
2009/0118968 A1 5/2009 Livshiz et al.
2009/0118969 A1 5/2009 Heap et al.
2009/0118972 A1 5/2009 Baur et al.
2009/0143959 A1 6/2009 Yamaoka et al.
2009/0229562 A1 9/2009 Ramappan et al.
2009/0292435 A1 11/2009 Costin et al.
2010/0049419 A1 2/2010 Yoshikawa et al.
2010/0057283 A1 3/2010 Worthing et al.
2010/0057329 A1 3/2010 Livshiz et al.
2010/0075803 A1 3/2010 Sharples et al.
2010/0116249 A1 * 5/2010 Guerrassi ..... F02D 35/023 123/435
2010/0116250 A1 5/2010 Simon, Jr. et al.
2010/0180876 A1 7/2010 Leroy et al.
2010/0211294 A1 8/2010 Soejima
2010/0263627 A1 10/2010 Whitney et al.
2010/0268436 A1 10/2010 Soejima et al.
2010/0280738 A1 11/2010 Whitney et al.
2011/0034298 A1 2/2011 Doering et al.
2011/0045948 A1 2/2011 Doering et al.
2011/0066308 A1 * 3/2011 Yang ..... B60W 20/12 701/22
2011/0087421 A1 4/2011 Soejima et al.
2011/0100013 A1 5/2011 Whitney et al.
2011/0113773 A1 5/2011 Liu et al.
2011/0144838 A1 6/2011 Matthews et al.
2012/0065864 A1 3/2012 Whitney et al.
2012/0150399 A1 6/2012 Kar et al.
2013/0032123 A1 2/2013 Kinugawa et al.
2013/0032127 A1 2/2013 Jentz et al.
2013/0060448 A1 3/2013 Nakada
2013/0080023 A1 3/2013 Livshiz et al.
2013/0104859 A1 5/2013 Miyazaki et al.
2013/0151124 A1 6/2013 Seiberlich et al.
2013/0184961 A1 * 7/2013 Kumar ..... F02C 9/28 701/100
2013/0213353 A1 8/2013 Rollinger et al.
2014/0076279 A1 3/2014 Livshiz et al.
2014/0311446 A1 10/2014 Whitney et al.
2014/0316681 A1 10/2014 Whitney et al.
2014/0316682 A1 10/2014 Whitney et al.
2014/0316683 A1 10/2014 Whitney et al.
2015/0039206 A1 2/2015 Storch et al.
2015/0275569 A1 10/2015 LeBlanc
2015/0275711 A1 10/2015 Whitney et al.
2015/0275771 A1 10/2015 Pochner et al.
2015/0275772 A1 10/2015 Long et al.
2015/0275783 A1 10/2015 Wong et al.
2015/0275784 A1 10/2015 Whitney et al.
2015/0275785 A1 10/2015 Cygan, Jr. et al.
2015/0275786 A1 10/2015 Jin et al.
2015/0275789 A1 10/2015 Cygan, Jr. et al.
2015/0275792 A1 10/2015 Genslak et al.
2015/0275794 A1 10/2015 Verdejo et al.
2015/0275795 A1 10/2015 Cygan, Jr. et al.
2015/0275796 A1 10/2015 Pochner et al.
2015/0275806 A1 10/2015 Genslak et al.

OTHER PUBLICATIONS

U.S. Appl. No. 14/675,860, filed Apr. 2001, Long et al.

John C. G. Boot; "Quadratic Programming: Algorithms, Anomalies, Applications vol. 2 of Studies in mathematical and managerial economics"; North-Holland Publ.Comp., 1964; 213 pages.

(56) References Cited

OTHER PUBLICATIONS

N. Lawrence Ricker; "Use of quadratic programming for constrained internal model control"; Ind. Eng. Chem. Process Des. Dev., 1985, pp. 925-936.
C. E. Lemke; "A Method of Solution for Quadratic Programs"; Rensselaer Polytechnic Institute, Troy, New York, Published Online: Jul. 1, 1962, pp. 442-453.
U.S. Appl. No. 14/617,068, filed Feb. 9, 2015, Whitney et al.
U.S. Appl. No. 14/931,134, filed Nov. 3, 2015, Wong et al.
U.S. Appl. No. 13/613,588, filed Sep. 13, 2012, Livshiz et al.
U.S. Appl. No. 13/613,683, filed Sep. 13, 2012, Livshiz et al.
U.S. Appl. No. 13/686,069, filed Nov. 27, 2012, Livshiz et al.
U.S. Appl. No. 13/911,121, filed Jun. 6, 2013, Whitney et al.
U.S. Appl. No. 13/911,132, filed Jun. 6, 2013, Whitney et al.
U.S. Appl. No. 13/911,148, filed Jun. 6, 2013, Whitney et al.
U.S. Appl. No. 13/911,156, filed Jun. 6, 2013, Whitney et al.
U.S. Appl. No. 14/032,508, filed Sep. 20, 2013, Storch et al.
U.S. Appl. No. 14/225,492, filed Mar. 26, 2014, Wong et al.
U.S. Appl. No. 14/225,496, filed Mar. 26, 2014, Pochner et al.
U.S. Appl. No. 14/225,502, filed Mar. 26, 2014, Long et al.
U.S. Appl. No. 14/225,507, filed Mar. 26, 2014, Jin et al.
U.S. Appl. No. 14/225,516, filed Mar. 26, 2014, Whitney et al.
U.S. Appl. No. 14/225,531, filed Mar. 26, 2014, Genslak et al.
U.S. Appl. No. 14/225,569, filed Mar. 26, 2014, Long et al.
U.S. Appl. No. 14/225,587, filed Mar. 26, 2014, Cygan, Jr. et al.
U.S. Appl. No. 14/225,626, filed Mar. 26, 2014, Verdejo et al.
U.S. Appl. No. 14/225,808, filed Mar. 26, 2014, Whitney et al.
U.S. Appl. No. 14/225,817, filed Mar. 26, 2014, Cygan, Jr. et al.
U.S. Appl. No. 14/225,891, filed Mar. 26, 2014, Genslak et al.
U.S. Appl. No. 14/225,896, filed Mar. 26, 2014, Cygan, Jr. et al.
U.S. Appl. No. 14/226,121, filed Mar. 26, 2014, Wong et al.
Kolmanovsky, I., "Towards Engine and Powertrain Control Based on Model Predictive Control," (Sep. 28, 2012), Powerpoint Presentation, 47 slides.

* cited by examiner

MODEL PREDICTIVE CONTROL SYSTEMS AND METHODS FOR FUTURE TORQUE CHANGES

CROSS-REFERENCE TO RELATED APPLICATIONS

This application is related to U.S. patent application Ser. No. 14/225,502 filed on Mar. 26, 2014, Ser. No. 14/225,516 filed on Mar. 26, 2014, Ser. No. 14/225,569 filed on Mar. 26, 2014, Ser. No. 14/225,626 filed on Mar. 26, 2014, Ser. No. 14/225,817 filed on Mar. 26, 2014, Ser. No. 14/225,896 filed on Mar. 26, 2014, Ser. No. 14/225,531 filed on Mar. 26, 2014, Ser. No. 14/225,507 filed on Mar. 26, 2014, Ser. No. 14/225,808 filed on Mar. 26, 2014, Ser. No. 14/225,587 filed on Mar. 26, 2014, Ser. No. 14/225,492 filed on Mar. 26, 2014, Ser. No. 14/226,121 filed on Mar. 26, 2014, Ser. No. 14/225,496 filed on Mar. 26, 2014, and Ser. No. 14/225,891 filed on Mar. 26, 2014. The entire disclosure of the above applications are incorporated herein by reference.

FIELD

The present disclosure relates to internal combustion engines and more particularly to engine control systems and methods for vehicles.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. Air flow into the engine is regulated via a throttle. More specifically, the throttle adjusts throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

In spark-ignition engines, spark initiates combustion of an air/fuel mixture provided to the cylinders. In compression-ignition engines, compression in the cylinders combusts the air/fuel mixture provided to the cylinders. Spark timing and air flow may be the primary mechanisms for adjusting the torque output of spark-ignition engines, while fuel flow may be the primary mechanism for adjusting the torque output of compression-ignition engines.

Engine control systems have been developed to control engine output torque to achieve a desired torque. Traditional engine control systems, however, do not control the engine output torque as accurately as desired. Further, traditional engine control systems do not provide a rapid response to control signals or coordinate engine torque control among various devices that affect the engine output torque.

SUMMARY

In a feature, an engine control system of a vehicle is disclosed. A prediction module, based on a set of possible target values for M future times and a model of an engine, determines predicted torques of the engine for the M future times, respectively. M is an integer greater than one. A cost module determines a cost for the set of possible target values based on comparisons of the predicted torques for the M future times with engine torque requests for the M future times, respectively. A selection module, based on the cost, selects the set of possible target values from a group including the set of possible target values and N other sets of possible target values, wherein N is an integer greater than zero, and sets target values based on the selected set of possible target values. An actuator module controls an engine actuator based on a first one of the target values.

In further features: based on the set of possible target and the model of the engine, the prediction module further determines a predicted fuel efficiency of the engine; and the cost module determines the cost for the set of possible target values further based on a comparison of the predicted fuel efficiency with a predetermined maximum fuel efficiency.

In still further features: based on the set of possible target and the model of the engine, the prediction module further determines a predicted noise, vibration, and harshness (NVH) value; and the cost module determines the cost for the set of possible target values further based on a comparison of the predicted NVH value with a predetermined NVH value.

In yet further features, a future request module sets at least one of the engine torque requests for the M future times based on a gear shift of a transmission.

In further features, a future request module sets at least one of the engine torque requests for the M future times based on a change in an accelerator pedal position.

In still further features, a future request module sets at least one of the engine torque requests for the M future times based on a change in a load on the engine.

In yet further features, a future request module sets at least one of the engine torque requests for the M future times based on a change in torque of an electric motor.

In further features, a future request module sets at least one of the engine torque requests for the M future times when a sport mode of operation is selected for the vehicle.

In still further features, the selection module selects the set of possible target values from the group based on the cost being less than costs of the N other sets of possible target values, respectively.

In yet further features: a boost actuator module that controls opening of a wastegate of a turbocharger based on a second one of the target values; an exhaust gas recirculation (EGR) actuator module that controls opening of an EGR valve based on a third one of the target values; a phaser actuator module that controls intake and exhaust valve phasing based on fourth and fifth ones of the target values, respectively; a spark actuator module that controls spark timing based on a sixth one of the target values; and a fuel actuator module that controls fueling based on a seventh one of the target values, wherein the actuator module controls the opening of a throttle valve based on the one of the target values.

An engine control method for a vehicle includes: based on a set of possible target values for M future times and a model of an engine, determining predicted torques of the engine for the M future times, respectively, wherein M is an integer greater than one; determining a cost for the set of possible target values based on comparisons of the predicted torques for the M future times with engine torque requests for the M future times, respectively; based on the cost, selecting the set of possible target values from a group including the set of possible target values and N other sets of possible target values, wherein N is an integer greater than zero; setting target values based on the selected set of possible target values; and controlling an engine actuator based on a first one of the target values.

In further features, the engine control method further includes: based on the set of possible target and the model of the engine, determining a predicted fuel efficiency of the engine; and determining the cost for the set of possible target values further based on a comparison of the predicted fuel efficiency with a predetermined maximum fuel efficiency.

In still further features, the engine control method further includes: based on the set of possible target and the model of the engine, determining a predicted noise, vibration, and harshness (NVH) value; and determining the cost for the set of possible target values further based on a comparison of the predicted NVH value with a predetermined NVH value.

In yet further features, the engine control method further includes setting at least one of the engine torque requests for the M future times based on a gear shift of a transmission.

In further features, the engine control method further includes setting at least one of the engine torque requests for the M future times based on a change in an accelerator pedal position.

In still further features, the engine control method further includes setting at least one of the engine torque requests for the M future times based on a change in a load on the engine.

In yet further features, the engine control method further includes setting at least one of the engine torque requests for the M future times based on a change in torque of an electric motor.

In further features, the engine control method further includes setting at least one of the engine torque requests for the M future times when a sport mode of operation is selected for the vehicle.

In still further features, the engine control method further includes selecting the set of possible target values from the group based on the cost being less than costs of the N other sets of possible target values, respectively.

In yet further features, the engine control method further includes: controlling opening of a wastegate of a turbocharger based on a second one of the target values; controlling opening of an exhaust gas recirculation (EGR) valve based on a third one of the target values; controlling intake and exhaust valve phasing based on fourth and fifth ones of the target values, respectively; controlling spark timing based on a sixth one of the target values; and controlling fueling based on a seventh one of the target values, wherein the engine actuator is a throttle valve.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
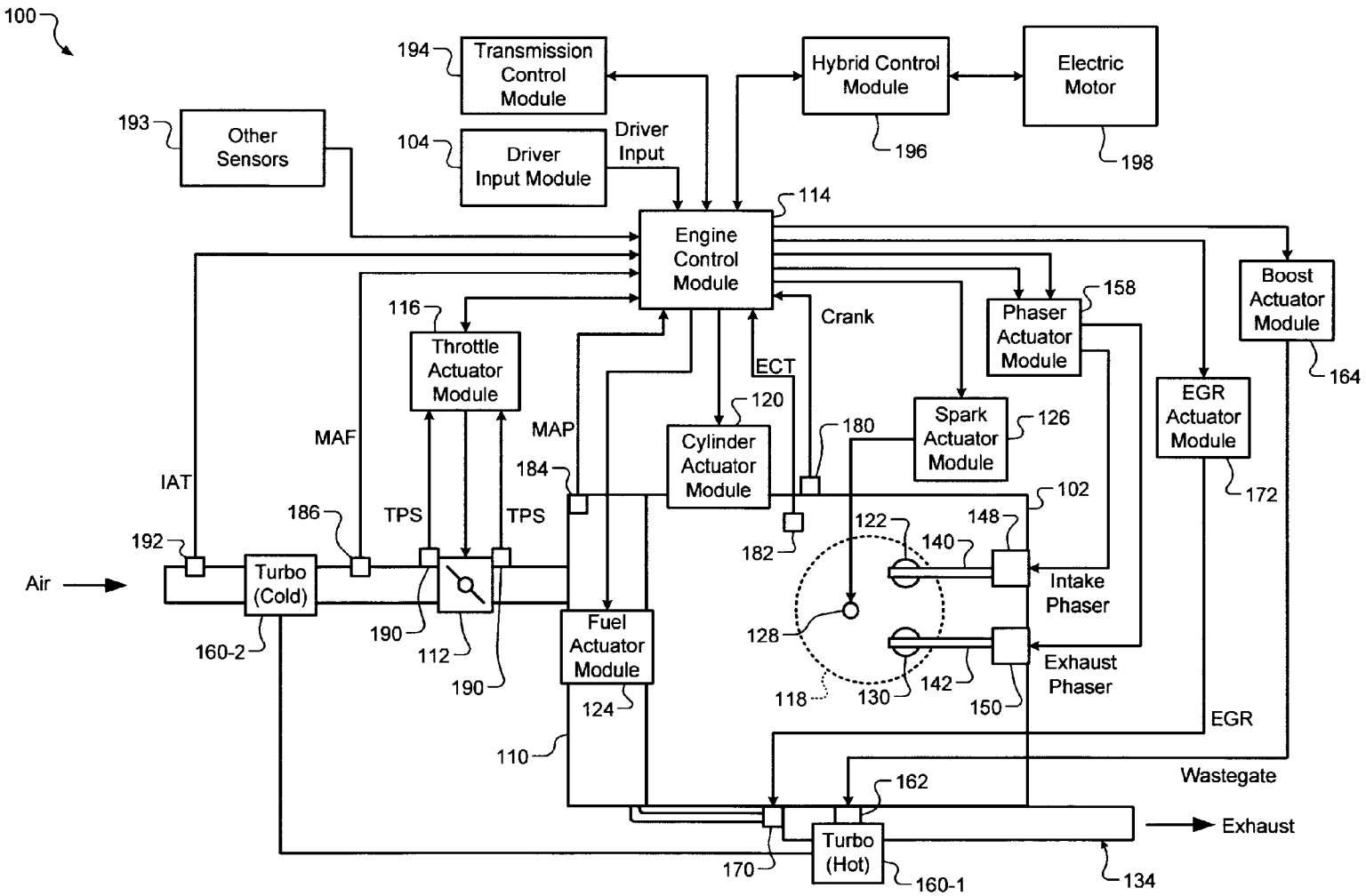
FIG. 1 is a functional block diagram of an example engine system according to the present disclosure.

An engine control module (ECM) controls torque output of an engine. More specifically, the ECM controls actuators of the engine based on target values, respectively, based on a requested amount of torque. For example, the ECM controls intake and exhaust camshaft phasing based on target intake and exhaust phaser angles, a throttle valve based on a target throttle opening, an exhaust gas recirculation (EGR) valve based on a target EGR opening, and a wastegate of a turbocharger based on a target wastegate duty cycle. The ECM also controls spark timing based on a target spark timing and fueling based on target fueling parameters.

The ECM could determine the target values individually using multiple single input single output (SISO) controllers, such as proportional integral derivative (PID) controllers. However, when multiple SISO controllers are used, the target values may be set to maintain system stability at the expense of possible fuel consumption decreases. Additionally, calibration and design of the individual SISO controllers may be costly and time consuming.

The ECM of the present disclosure generates the target values using a model predictive control (MPC) module. The MPC module identifies possible sets of target values. The MPC module determines predicted parameters for each of the possible sets based on the possible sets' target values and a mathematical model of the engine. For example, the MPC module may determine a predicted engine torque and one or more other predicted parameters for each of the possible sets of target values.

The MPC module may also determine a cost associated with use of each of the possible sets. For example, the cost of a possible set that is predicted to more closely track an engine torque request may be lower than other possible sets that are not expected to track the engine torque request as closely. The MPC module may select a possible set that has the lowest cost and that satisfies various constraints for use to control the actuators. In various implementations, instead of or in addition to identifying possible sets of target values and determining the cost of each of the sets, the MPC module may generate a surface representing the cost of possible sets of target values. The MPC module may then identify the possible set that has the lowest cost based on the slope of the cost surface.

Under some circumstances, changes in the engine torque request may be anticipated in advance of the change actually occurring. For example, changes in the engine torque request may be anticipated when a gear shift will be performed, when a load will be imposed on the engine (e.g., air conditioning compressor), and under other circumstances.

According to the present disclosure, the costs are determined further based on one or more future torque requests. The MPC module will therefore select a possible set that prepares the engine to achieve the future torque requests. This may enable the engine to more quickly respond in the future when the change in the engine torque request occurs.

Referring now to FIG. 1, a functional block diagram of an example engine system 100 is presented. The engine system 100 includes an engine 102 that combusts an air/fuel mixture to produce drive torque for a vehicle based on driver input from a driver input module 104. The engine 102 may be a gasoline spark ignition internal combustion engine.

Air is drawn into an intake manifold 110 through a throttle valve 112. For example only, the throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate some of the cylinders, which may improve fuel economy under certain engine operating conditions.

The engine 102 may operate using a four-stroke cycle. The four strokes, described below, may be referred to as the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates fuel injection to achieve a target air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. A spark actuator module 126 energizes a spark plug 128 in the cylinder 118 based on a signal from the ECM 114, which ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. Generating spark may be referred to as a firing event. The spark actuator module 126 may have the ability to vary the timing of the spark for each firing event. The spark actuator module 126 may vary the spark timing for a next firing event when the spark timing is changed between a last firing event and the next firing event. The spark actuator module 126 may halt provision of spark to deactivated cylinders.

During the combustion stroke, the combustion of the air/fuel mixture drives the piston away from TDC, thereby driving the crankshaft. The combustion stroke may be defined as the time between the piston reaching TDC and the time at which the piston reaches bottom dead center (BDC). During the exhaust stroke, the piston begins moving away from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118). In various other implementations, the intake valve 122 and/or the exhaust valve 130 may be controlled by devices other than camshafts, such as camless valve actuators. The cylinder actuator module 120 may deactivate the cylinder 118 by disabling opening of the intake valve 122 and/or the exhaust valve 130.

The time when the intake valve 122 is opened may be varied with respect to piston TDC by an intake cam phaser 148. The time when the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. When implemented, variable valve lift (not shown) may also be controlled by the phaser actuator module 158.

The engine system 100 may include a turbocharger that includes a hot turbine 160-1 that is powered by hot exhaust gases flowing through the exhaust system 134. The turbocharger also includes a cold air compressor 160-2 that is driven by the turbine 160-1. The compressor 160-2 compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) provided by the turbocharger. A boost actuator module 164 may control the boost of the turbocharger by controlling opening of the wastegate 162. In various implementations, two or more turbochargers may be implemented and may be controlled by the boost actuator module 164.

An air cooler (not shown) may transfer heat from the compressed air charge to a cooling medium, such as engine coolant or air. An air cooler that cools the compressed air charge using engine coolant may be referred to as an intercooler. An air cooler that cools the compressed air charge using air may be referred to as a charge air cooler. The compressed air charge may receive heat, for example, via compression and/or from components of the exhaust system 134. Although shown separated for purposes of illustration, the turbine 160-1 and the compressor 160-2 may be attached to each other, placing intake air in close proximity to hot exhaust.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172 based on signals from the ECM 114.

A position of the crankshaft may be measured using a crankshaft position sensor 180. A rotational speed of the crankshaft (an engine speed) may be determined based on the crankshaft position. A temperature of the engine coolant may be measured using an engine coolant temperature (ECT) sensor 182. The ECT sensor 182 may be located within the engine 102 or at other locations where the coolant is circulated, such as a radiator (not shown).

A pressure within the intake manifold 110 may be measured using a manifold absolute pressure (MAP) sensor 184. In various implementations, engine vacuum, which is the difference between ambient air pressure and the pressure within the intake manifold 110, may be measured. A mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. An ambient temperature of air being drawn into the engine 102 may be measured using an intake air temperature (IAT) sensor 192. The engine system 100 may also include one or more other sensors 193, such as an ambient humidity sensor, one or more knock sensors, a compressor outlet pressure sensor and/or a throttle inlet pressure sensor, a wastegate position sensor, an EGR position sensor, and/or one or more other suitable sensors. The ECM 114 may use signals from the sensors to make control decisions for the engine system 100.

The ECM 114 may communicate with a transmission control module 194 to coordinate shifting gears in a transmission (not shown). For example, the ECM 114 may reduce engine torque during a gear shift. The ECM 114 may communicate with a hybrid control module 196 to coordinate operation of the engine 102 and an electric motor 198.

The electric motor 198 may also function as a generator, and may be used to produce electrical energy for use by vehicle electrical systems and/or for storage in a battery. In various implementations, various functions of the ECM 114, the transmission control module 194, and the hybrid control module 196 may be integrated into one or more modules.

Each system that varies an engine parameter may be referred to as an engine actuator. For example, the throttle actuator module 116 may adjust opening of the throttle valve 112 to achieve a target throttle opening area. The spark actuator module 126 controls the spark plugs to achieve a target spark timing relative to piston TDC. The fuel actuator module 124 controls the fuel injectors to achieve target fueling parameters. The phaser actuator module 158 may control the intake and exhaust cam phasers 148 and 150 to achieve target intake and exhaust cam phaser angles, respectively. The EGR actuator module 172 may control the EGR valve 170 to achieve a target EGR opening area. The boost actuator module 164 controls the wastegate 162 to achieve a target wastegate opening area. The cylinder actuator module 120 controls cylinder deactivation to achieve a target number of activated or deactivated cylinders.

The ECM 114 generates the target values for the engine actuators to cause the engine 102 to generate a target engine output torque. The ECM 114 generates the—target values for the engine actuators using model predictive control, as discussed further below.

Figure 2:
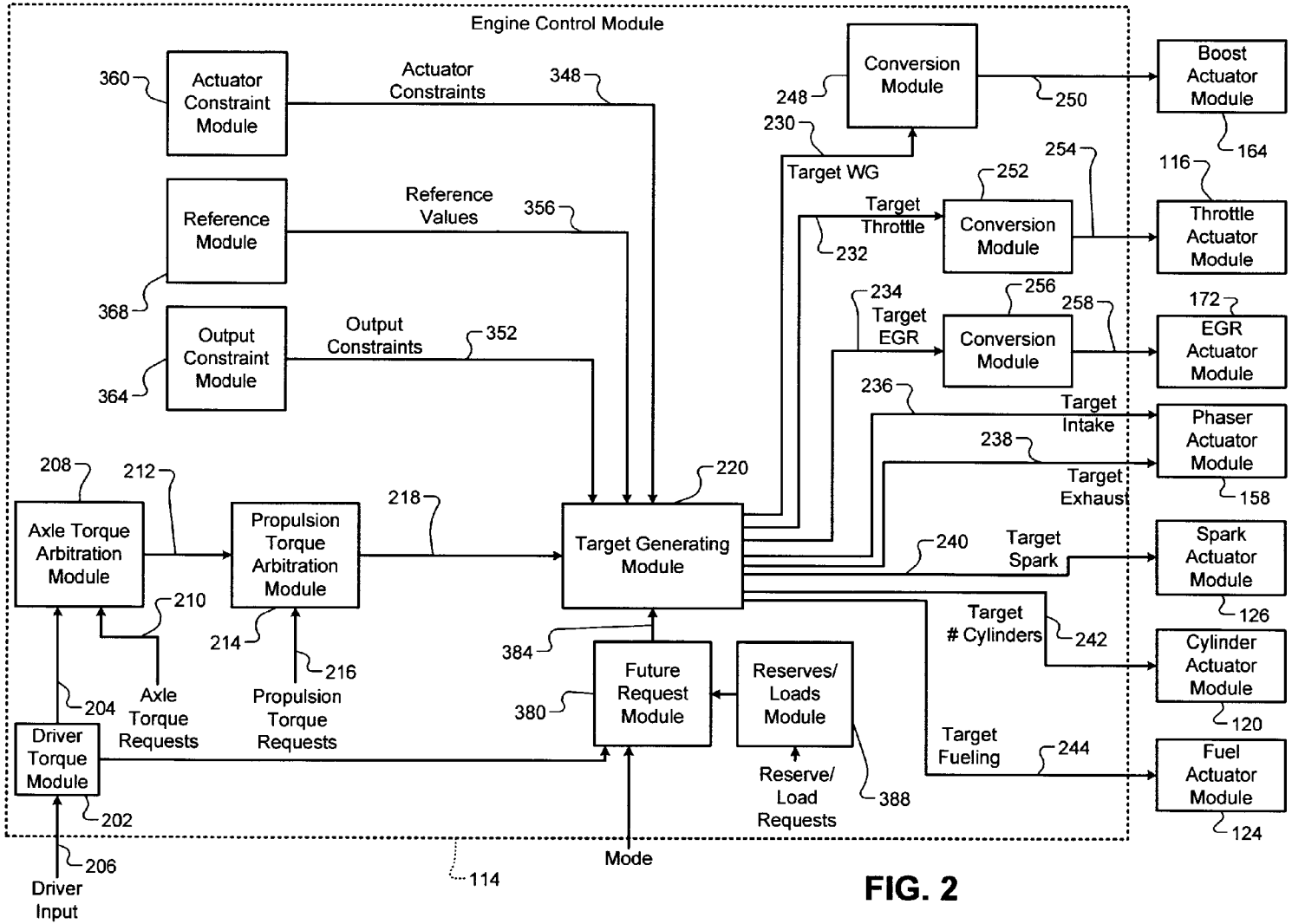
FIG. 2 is a functional block diagram of an example engine control system according to the present disclosure.

Referring now to FIG. 2, a functional block diagram of an example engine control system is presented. A driver torque module 202 determines a driver torque request 204 based on a driver input 206 from the driver input module 104. The driver input 206 may be based on, for example, a position of an accelerator pedal and a position of a brake pedal. The driver input 206 may also be based on cruise control, which may be an adaptive cruise control system that varies vehicle speed to maintain a predetermined following distance. The driver torque module 202 may store one or more mappings of accelerator pedal position to target torque and may determine the driver torque request 204 based on a selected one of the mappings. The driver torque module 202 may also apply one or more filters to rate limit changes in the driver torque request 204.

An axle torque arbitration module 208 arbitrates between the driver torque request 204 and other axle torque requests 210. Axle torque (torque at the wheels) may be produced by various sources including an engine and/or an electric motor. For example, the axle torque requests 210 may include a torque reduction requested by a traction control system when positive wheel slip is detected. Positive wheel slip occurs when axle torque overcomes friction between the wheels and the road surface, and the wheels begin to slip against the road surface. The axle torque requests 210 may also include a torque increase request to counteract negative wheel slip, where a tire of the vehicle slips in the other direction with respect to the road surface because the axle torque is negative.

The axle torque requests 210 may also include brake management requests and vehicle over-speed torque requests. Brake management requests may reduce axle torque to ensure that the axle torque does not exceed the ability of the brakes to hold the vehicle when the vehicle is stopped. Vehicle over-speed torque requests may reduce the axle torque to prevent the vehicle from exceeding a predetermined speed. The axle torque requests 210 may also be generated by vehicle stability control systems.

The axle torque arbitration module 208 outputs an axle torque request 212 based on the results of arbitrating between the received axle torque requests 204 and 210. As described below, the axle torque request 212 from the axle torque arbitration module 208 may selectively be adjusted by other modules of the ECM 114 before being used to control the engine actuators.

The axle torque arbitration module 208 may output the axle torque request 212 to a propulsion torque arbitration module 214. In various implementations, the axle torque arbitration module 208 may output the axle torque request 212 to a hybrid optimization module (not shown). The hybrid optimization module may determine how much torque should be produced by the engine 102 and how much torque should be produced by the electric motor 198. The hybrid optimization module then outputs a modified torque request to the propulsion torque arbitration module 214.

The propulsion torque arbitration module 214 converts the axle torque request 212 from an axle torque domain (torque at the wheels) into a propulsion torque domain (torque at the crankshaft). The propulsion torque arbitration module 214 arbitrates between the (converted) axle torque request 212 and other propulsion torque requests 216. The propulsion torque arbitration module 214 generates a propulsion torque request 218 as a result of the arbitration.

For example, the propulsion torque requests 216 may include torque reductions for engine over-speed protection, torque increases for stall prevention, and torque reductions requested by the transmission control module 194 to accommodate gear shifts. The propulsion torque requests 216 may also result from clutch fuel cutoff, which reduces the engine output torque when the driver depresses the clutch pedal in a manual transmission vehicle to prevent a flare in engine speed.

The propulsion torque requests 216 may also include an engine shutoff request, which may be initiated when a critical fault is detected. For example only, critical faults may include detection of vehicle theft, a stuck starter motor, electronic throttle control problems, and unexpected torque increases. In various implementations, when an engine shutoff request is present, arbitration selects the engine shutoff request as the winning request. When the engine shutoff request is present, the propulsion torque arbitration module 214 may output zero as the propulsion torque request 218.

In various implementations, an engine shutoff request may simply shut down the engine 102 separately from the arbitration process. The propulsion torque arbitration module 214 may still receive the engine shutoff request so that, for example, appropriate data can be fed back to other torque requestors. For example, all other torque requestors may be informed that they have lost arbitration.

A target generating module 220 (see also FIG. 3) generates target values for the engine actuators based on the propulsion torque request 218 and other parameters as discussed further below. The target generating module 220 generates the target values using model predictive control (MPC). The propulsion torque request 218 may be a brake torque. Brake torque may refer to torque at the crankshaft under the current operating conditions.

The target values include a target wastegate opening area 230, a target throttle opening area 232, a target EGR opening area 234, a target intake cam phaser angle 236, and a target exhaust cam phaser angle 238. The target values also include a target spark timing 240, a target number of cylinders to be activated 242, and target fueling parameters 244. The boost actuator module 164 controls the wastegate 162 to achieve the target wastegate opening area 230. For example, a first conversion module 248 may convert the target wastegate opening area 230 into a target duty cycle 250 to be applied to the wastegate 162, and the boost actuator module 164 may apply a signal to the wastegate 162 based on the target duty cycle 250. In various implementations, the first conversion module 248 may convert the target wastegate opening area 230 into a target wastegate position (not shown), and convert the target wastegate position into the target duty cycle 250.

The throttle actuator module 116 controls the throttle valve 112 to achieve the target throttle opening area 232. For example, a second conversion module 252 may convert the target throttle opening area 232 into a target duty cycle 254 to be applied to the throttle valve 112, and the throttle actuator module 116 may apply a signal to the throttle valve 112 based on the target duty cycle 254. In various implementations, the second conversion module 252 may convert the target throttle opening area 232 into a target throttle position (not shown), and convert the target throttle position into the target duty cycle 254.

The EGR actuator module 172 controls the EGR valve 170 to achieve the target EGR opening area 234. For example, a third conversion module 256 may convert the target EGR opening area 234 into a target duty cycle 258 to be applied to the EGR valve 170, and the EGR actuator module 172 may apply a signal to the EGR valve 170 based on the target duty cycle 258. In various implementations, the third conversion module 256 may convert the target EGR opening area 234 into a target EGR position (not shown), and convert the target EGR position into the target duty cycle 258.

The phaser actuator module 158 controls the intake cam phaser 148 to achieve the target intake cam phaser angle 236. The phaser actuator module 158 also controls the exhaust cam phaser 150 to achieve the target exhaust cam phaser angle 238. In various implementations, a fourth conversion module (not shown) may be included and may convert the target intake and exhaust cam phaser angles 236 and 238 into target intake and exhaust duty cycles, respectively. The phaser actuator module 158 may apply the target intake and exhaust duty cycles to the intake and exhaust cam phasers 148 and 150, respectively. In various implementations, the target generating module 220 may determine a target valve overlap factor and a target effective displacement, and the phaser actuator module 158 may control the intake and exhaust cam phasers 148 and 150 to achieve the target overlap factor and the target effective displacement.

The spark actuator module 126 provides spark based on the target spark timing 240. In various implementations, the target generating module 220 may generate a target combustion phasing value, such as a target crankshaft angle where 50 percent of a provided mass of fuel will be burned (CA50). The target spark timing may be determined based on the target combustion phasing value and an estimated burn duration. The estimated burn duration may be determined, for example, based on APC, humidity, dilution, and temperature of air within a cylinder. Alternatively, the target generating module 220 may determine a target torque decrease, and the target spark timing 240 may be determined based on how far to retard the spark timing relative to an optimal spark timing to achieve the target torque decrease.

The cylinder actuator module 120 selectively activates and deactivates the valves of cylinders based on the target number of cylinders 242. Fueling and spark may also be disabled to cylinders that are deactivated. The target fueling parameters 244 may include, for example, target mass of fuel, target injection starting timing, and target number of fuel injections. The fuel actuator module 124 controls fueling based on the target fueling parameters 244.

Figure 3:
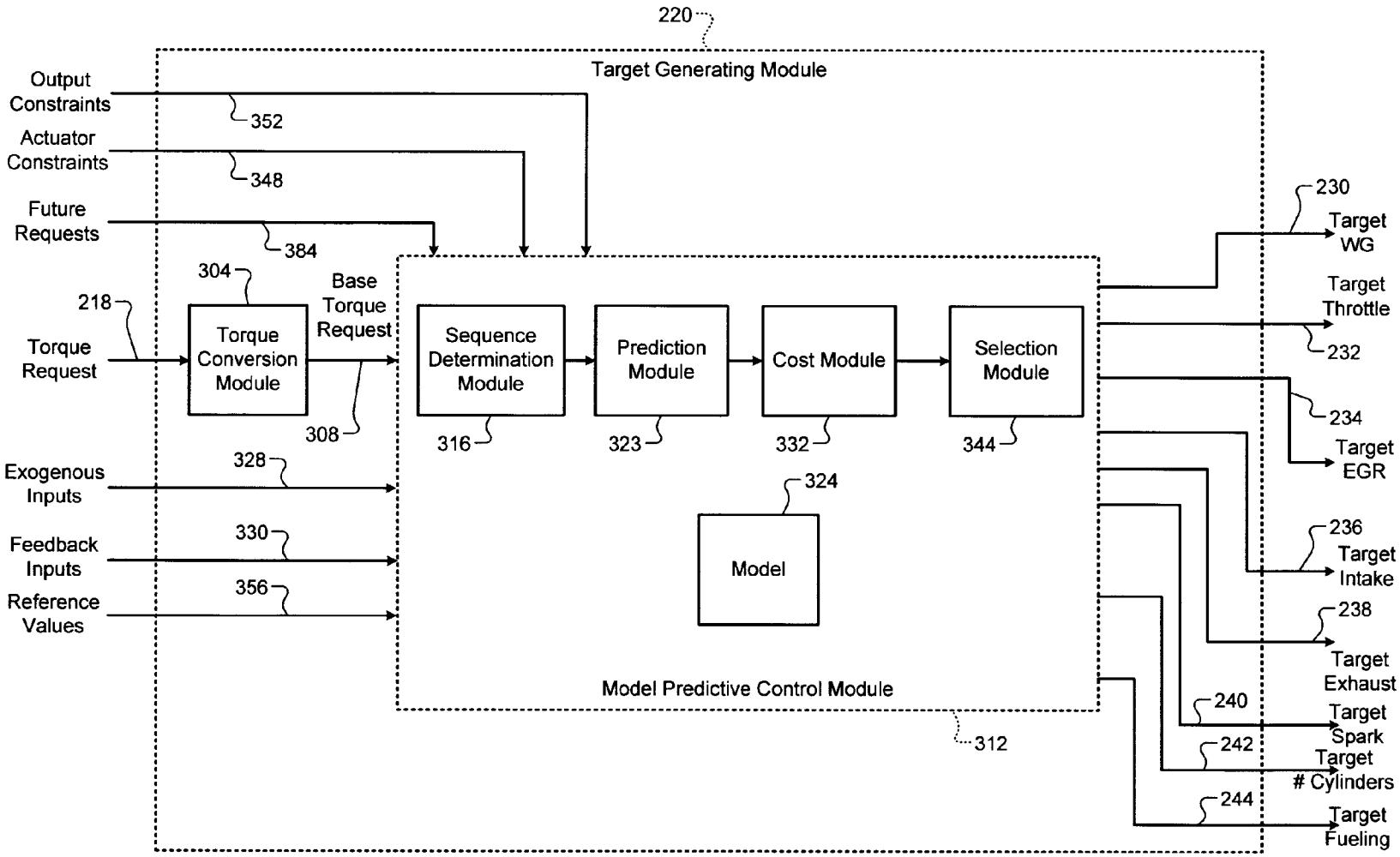
FIG. 3 is a functional block diagram of an example air control module according to the present disclosure.

FIG. 3 is a functional block diagram of an example implementation of the target generating module 220. Referring now to FIGS. 2 and 3, as discussed above, the propulsion torque request 218 may be a brake torque. A torque conversion module 304 converts the propulsion torque request 218 from brake torque into base torque. The torque request resulting from conversion into base torque will be referred to as a base torque request 308.

Base torques may refer to torque at the crankshaft made during operation of the engine 102 on a dynamometer while the engine 102 is warm and no torque loads are imposed on the engine 102 by accessories, such as an alternator and the A/C compressor. The torque conversion module 304 may convert the propulsion torque request 218 into the base torque request 308, for example, using a mapping or a function that relates brake torques to base torques. In various implementations, the torque conversion module 304 may convert the propulsion torque request 218 into another suitable type of torque, such as an indicated torque. An indicated torque may refer to a torque at the crankshaft attributable to work produced via combustion within the cylinders.

An MPC (model predictive control) module 312 generates the target values 230-244 using MPC. The MPC module 312 may be a single module or may comprise multiple modules. For example, the MPC module 312 may include a sequence determination module 316. The sequence determination module 316 determines possible sequences of the target values 230-244 that could be used together during N future control loops. Each of the possible sequences identified by the sequence determination module 316 includes one sequence of N values for each of the target values 230-244. In other words, each possible sequence includes a sequence of N values for the target wastegate opening area 230, a sequence of N values for the target throttle opening area 232, a sequence of N values for the target EGR opening area 234, a sequence of N values for the target intake cam phaser angle 236, and a sequence of N values for the target exhaust cam phaser angle 238. Each possible sequence also includes a sequence of N values for the target spark timing 240, the target number of cylinders 242, and the target fueling parameters 244. Each of the N values are for a corresponding one of the N future control loops. N is an integer greater than or equal to one.

A prediction module 323 determines predicted responses of the engine 102 to the possible sequences of the target values 230-244, respectively, based on a mathematical model 324 of the engine 102, exogenous inputs 328, and feedback inputs 330. For example, based on a possible sequence of the target values 230-244, the exogenous inputs 328, and the feedback inputs 330, using the model 324, the prediction module 323 generates a sequence of N predicted torques of the engine 102 for the N control loops, a sequence of N predicted fuel efficiency values for the N control loops, and a sequence of N predicted noise, vibration, and harshness (NVH) values for the N control loops. While an example of generating predicted torque, predicted fuel efficiency, and predicted NVH is described, the predicted parameters may include one or more other predicted operating parameters.

The model 324 may include, for example, a function or a mapping calibrated based on characteristics of the engine 102. The exogenous inputs 328 may include parameters that are not directly affected by the engine actuators. For example, the exogenous inputs 328 may include engine speed, turbocharger inlet air pressure, IAT, and/or one or more other parameters. The feedback inputs 330 may include, for example, an estimated torque output of the engine 102, an exhaust pressure downstream of the turbine 160-1 of the turbocharger, the IAT, an APC of the engine 102, an estimated residual dilution, an estimated external dilution, and/or one or more other suitable parameters. The feedback inputs 330 may be measured using sensors (e.g., the IAT) and/or estimated based on one or more other parameters.

For example, the prediction module 323 may generate the predicted parameters for a given sequence of possible target values based on the relationships:

$$x(k+1)=Ax(k)+Bu(k); \text{ and}$$

$$y(k)=Cx(k),$$

where x(k+1) is a vector with entries indicative of states of the engine 102 for a next control loop k+1, A is a matrix including constant values calibrated based on characteristics of the engine 102, x(k) is a vector with entries indicative of states of the engine 102 for the k-th control loop, B is a matrix including constant values calibrated based on characteristics of the engine 102, u(k) is a vector of including entries for the possible target values for the k-th control loop, y(k) is a vector including the predicted parameters for the k-th control loop, and C is a matrix including constant values calibrated based on characteristics of the engine 102. The vector x(k+1) determined during for the k-th control loop will be used as the vector x(k) for the next control loop k+1. The prediction module 323 generates the predicted parameters for each of M of the N future control loops, where M is an integer that is greater than zero and less than or equal to N (i.e., k=0, 1, . . . M). The relationships can also be written as:

$$x(k)=Ax(k-1)+Bu(k-1); \text{ and}$$

$$y(k)=Cx(k),$$

where k is a control loop, x(k−1) is a vector with entries indicative of states of the engine 102 for a last control loop, A is a matrix including constant values calibrated based on characteristics of the engine 102, x(k) is a vector with entries indicative of states of the engine 102 for the k-th control loop, B is a matrix including constant values calibrated based on characteristics of the engine 102, u(k−1) is a vector of including entries for the possible target values for the last control loop k−1.

How the components of the above relationships can be re-written for the example of the predicted parameters including predicted torque, predicted fuel efficiency, and predicted NVH will now be described. The vector x(k+1) can be re-written as:

$$x(k+1)=\begin{bmatrix} x1(k+1) \\ x2(k+1) \\ x3(k+1) \end{bmatrix},$$

where x1(k+1) is a first state parameter of the engine 102 for the next control loop, x2(k+1) is a second state parameter of the engine 102 for the next control loop, and x3(k+1) is a third state parameter of the engine 102 for the next control loop.

The matrix A can be re-written as:

$$A=\begin{bmatrix} a11 & a12 & a13 \\ a21 & a22 & a23 \\ a31 & a32 & a33 \end{bmatrix}$$

where a11-a33 are constant values calibrated based on characteristics of the engine 102.

The vector x(k) can be re-written as:

$$x(k)=\begin{bmatrix} x1(k) \\ x2(k) \\ x3(k) \end{bmatrix},$$

where x1(k) is the first state parameter of the engine 102 for the k-th control loop, x2(k) is the second state parameter of the engine 102 for the k-th control loop, and x3(k) is the third state parameter of the engine 102 for k-th control loop. The entries of the vector x(k) are the entries of the vector x(k+1) calculated for the last control loop. The entries of the vector x(k+1) calculated for the k-th control loop are used for the next control loop as the entries of vector x(k).

The matrix B can be re-written as:

$$B=\begin{bmatrix} b11 & b12 & b13 & b14 & b15 & b16 & b17 & b18 \\ b21 & b22 & b23 & b24 & b25 & b26 & b27 & b28 \\ b31 & b32 & b33 & b34 & b35 & b36 & b37 & b38 \end{bmatrix}$$

where b11-b38 are constant values calibrated based on characteristics of the engine 102.

The vector u(k) can be re-written as:

$$u(k)=\begin{bmatrix} PTT(k) \\ PTWG(k) \\ PTEGR(k) \\ PTICP(k) \\ PTECP(k) \\ PTS(k) \\ PTN(k) \\ PTF(k) \end{bmatrix},$$

where PTT(k) is a possible target throttle opening of a possible sequence for the k-th control loop, PTVVG(k) is a possible target wastegate opening of the possible sequence for the k-th control loop, PTEGR(k) is a possible target EGR opening of the possible sequence for the k-th control loop, PTICP(k) is a possible target intake cam phasing value of the possible sequence for the k-th control loop, and PTECP(k) is a possible target exhaust cam phasing value of the possible sequence for the k-th control loop. PTS(k) is a possible target spark timing for the k-th control loop, PTN(k) is a possible number of cylinders for the k-th control loop, and PTF(k) includes possible fueling parameters for the k-th control loop.

The vector y(k) can be re-written as:

$$y(k) = \begin{bmatrix} PT(k) \\ PF(k) \\ PNVH(k) \end{bmatrix},$$

where PT(k) is a predicted torque of the engine 102 for the k-th control loop, PF(k) is a predicted fuel efficiency of the engine 102 for the k-th control loop, and PNVH(k) is a predicted NVH for the k-th control loop.

The matrix C can be re-written as:

$$C = \begin{bmatrix} c11 & c12 & c13 \\ c21 & c22 & c23 \\ c31 & c32 & c33 \end{bmatrix}$$

where c11-c33 are constant values calibrated based on characteristics of the engine 102.

The model 324 may include several different sets of the A, B, and C matrices for different operating conditions. The prediction module 323 may select which set of the A, B, and C matrices to use based on the engine speed, engine load, and/or one or more other parameters.

A cost module 332 determines a cost value for each of the possible sequences of the target values 230-244 based on the predicted parameters determined for a possible sequence and output reference values 356. An example cost determination is discussed further below.

A selection module 344 selects one of the possible sequences of the target values 230-244 based on the costs of the possible sequences, respectively. For example, the selection module 344 may select the one of the possible sequences having the lowest cost while satisfying actuator constraints 348 and output constraints 352. In various implementations, the model 324 may select the one of the possible sequences having the lowest cost while satisfying the actuator constraints 348 and the output constraints 352.

In various implementations, satisfaction of the output constraints 352 may be considered in the cost determination. In other words, the cost module 332 may determine the cost values further based on the output constraints 352. As discussed further below, based on how the cost values are determined, the selection module 344 will select the one of the possible sequences that best achieves the base torque request 308, minimizes the NVH, and maximizes the fuel efficiency.

The selection module 344 may set the target values 230-244 to the first ones of the N values of the selected possible sequence, respectively. In other words, the selection module 344 sets the target wastegate opening area 230 to the first one of the N values in the sequence of N values for the target wastegate opening area 230, set the target throttle opening area 232 to the first one of the N values in the sequence of N values for the target throttle opening area 232, set the target EGR opening area 234 to the first one of the N values in the sequence of N values for the target EGR opening area 234, set the target intake cam phaser angle 236 to the first one of the N values in the sequence of N values for the target intake cam phaser angle 236, and set the target exhaust cam phaser angle 238 to the first one of the N values in the sequence of N values for the target exhaust cam phaser angle 238. The selection module 344 also sets the target spark timing 240 to the first one of the N values in the sequence of N values for the target spark timing 240, the target number of cylinders 242 to the first one of the N values in the sequence of N values for the target number of cylinders 242, and the target fueling parameters 244 to the first one of the N values in the sequence of N values for the target fueling parameters 244.

During a next control loop, the MPC module 312 identifies possible sequences, generates the predicted parameters for the possible sequences, determines the cost of each of the possible sequences, selects of one of the possible sequences, and sets of the target values 230-244 to the first set of the target values 230-244 in the selected possible sequence. This process continues for each control loop.

An actuator constraint module 360 (see FIG. 2) sets the actuator constraints 348 for each of the target values 230-244. In other words, the actuator constraint module 360 sets actuator constraints for the throttle valve 112, actuator constraints for the EGR valve 170, actuator constraints for the wastegate 162, actuator constraints for the intake cam phaser 148, and actuator constraints for the exhaust cam phaser 150. The actuator constraint module 360 also sets actuator constraints for the spark actuator module 126, actuator constraints for the cylinder actuator module 120, and actuator constraints for the fuel actuator module 124.

The actuator constraints 348 for each one of the target values 230-244 may include a maximum value for an associated target value and a minimum value for that target value. The actuator constraint module 360 may generally set the actuator constraints 348 to predetermined operational ranges for the associated engine actuators. More specifically, the actuator constraint module 360 may generally set the actuator constraints 348 to predetermined operational ranges for the throttle valve 112, the EGR valve 170, the wastegate 162, the intake cam phaser 148, the exhaust cam phaser 150, the spark actuator module 126, the cylinder actuator module 120, and the fuel actuator module 124, respectively.

An output constraint module 364 (see FIG. 2) sets the output constraints 352 for the predicted torque output of the engine 102, the predicted fuel efficiency, and the predicted NVH. The output constraints 352 for each one of the predicted parameters may include a maximum value for an associated predicted parameter and a minimum value for that predicted parameter. For example, the output constraints 352 may include a minimum torque, a maximum torque, a minimum fuel efficiency and a maximum fuel efficiency, a minimum NVH value, and a maximum NVH value.

The output constraint module 364 may generally set the output constraints 352 to predetermined ranges for the associated predicted parameters, respectively. However, the output constraint module 364 may vary one or more of the output constraints 352 under some circumstances.

A reference module 368 (see FIG. 2) generates the reference values 356 for the target values 230-244, respectively. The reference values 356 include a reference for each of the target values 230-244. In other words, the reference values 356 include a reference wastegate opening area, a reference throttle opening area, a reference EGR opening area, a reference intake cam phaser angle, and a reference exhaust cam phaser angle. The reference values 356 also include a reference spark timing, a reference number of cylinders, and reference fueling parameters.

The reference module 368 may determine the reference values 356, for example, based on the propulsion torque request 218 and/or the base torque request 308. The reference values 356 provide references for setting the target values 230-244, respectively. The reference values 356 may be used to determine the cost values for possible sequences, as discussed further below. The reference values 356 may also be used for one or more other reasons, such as by the sequence determination module 316 to determine possible sequences.

Instead of or in addition to generating sequences of possible target values and determining the cost of each of the sequences, the MPC module 312 may identify a sequence of possible target values having the lowest cost using convex optimization techniques. For example, the MPC module 312 may determine the target values 230-244 using a quadratic programming (QP) solver, such as a Dantzig QP solver. In another example, the MPC module 312 may generate a surface of cost values for the possible sequences of the target values 230-244 and, based on the slope of the cost surface, identify a sequence of possible target values having the lowest cost. The MPC module 312 may then test that sequence of possible target values to determine whether that sequence of possible target values satisfies the actuator constraints 348. If so, the MPC module 312 may set the target values 230-244 to the first ones of the N values of that selected possible sequence, respectively, as discussed above.

If the actuator constraints 348 are not satisfied, the MPC module 312 selects another sequence of possible target values with a next lowest cost and tests that sequence of possible target values for satisfaction of the actuator constraints 348. The process of selecting a sequence and testing the sequence for satisfaction of the actuator constraints 348 may be referred to as an iteration. Multiple iterations may be performed during each control loop.

The MPC module 312 performs iterations until a sequence with the lowest cost that satisfies the actuator constraints 348 is identified. In this manner, the MPC module 312 selects the sequence of possible target values having the lowest cost while satisfying the actuator constraints 348 and the output constraints 352. If a sequence cannot be identified, the MPC module 312 may indicate that no solution is available.

The cost module 332 may determine the cost for the possible sequences of the target values 230-244 based on relationships between: the predicted torque and the base torque request 308; the predicted NVH and a predetermined minimum NVH; the predicted fuel efficiency and a predetermined maximum fuel efficiency; and the possible target values and the respective actuator constraints 348. The relationships may be weighted, for example, to control the effect that each of the relationships has on the cost.

For example only, the cost module 332 may determine the cost for a possible sequence of the target values 230-244 based on the following equation:

$$\text{Cost}=\Sigma_{i=1}^{N}\rho\epsilon^2+\|wT*(TP_i-BTR_i)\|^2+\|wF*(FEP_i-MaxFE)\|^2\|wNVH*(FEP_i-MinNVH)\|^2,$$

subject to the actuator constraints 348 and the output constraints 352. Cost is the cost for the possible sequence of the target values 230-244, TPi is the predicted torque of the engine 102 for an i-th one of the N control loops, BTRi is the base torque request 308 for the i-th one of the N control loops, and wT is a weighting value associated with the relationship between the predicted torque and the base torque request.

FEPi is the predicted fuel efficiency for the i-th one of the N control loops, MaxFE is the predetermined maximum fuel efficiency, and wF is a weighting value associated with the relationship between the predicted fuel efficiency and the predetermined maximum fuel efficiency. NVHi is the predicted NVH for the i-th one of the N control loops, MinNVH is the predetermined minimum NVH, and wNVH is a weighting value associated with the relationship between the predicted NVH and the predetermined minimum NVH.

The above equation can be expanded to:

$$\text{Cost}=\Sigma_{i=1}^{N}\rho\epsilon^2+\|wT*(TP_i-BTR_i)\|^2+\|wF*(FEP_i-MaxFE)\|^2+\|wNVH*(FEP_i-MinNVH)\|^2+\|wTV*(PTTOi-TORefi)\|^2+\|wWG*(PTWGOi-EGORefi)\|^2+\|wEGR*(PTEGROi-EGRORefi)\|^2+\|wIP*(PTICPi-ICPRefi)\|^2+\|wEP*(PTECPi-ECPRefi)\|^2+\|wS*(PSI-SRefi)\|^2+\|wN*(PNi-NRefi)\|^2+\|wF*(PFi-FRefi)\|^2,$$

subject to the actuator constraints 348 and the output constraints 352. PTTOi is a possible target throttle opening for the i-th one of the N control loops, TORef is the reference throttle opening for the i-th one of the N control loops, and wTV is a weighting value associated with the relationship between the possible target throttle openings and the reference throttle openings. PTWNGOi is a possible target wastegate opening for the i-th one of the N control loops, WGORef is the reference wastegate opening for the i-th one of the N control loops, and wWG is a weighting value associated with the relationship between the possible target wastegate openings and the reference wastegate openings.

PTEGROi is a possible target EGR opening for the i-th one of the N control loops, EGRRef is the reference EGR opening for the i-th one of the N control loops, and wEGR is a weighting value associated with the relationship between the possible target EGR openings and the reference EGR openings. PTICi is a possible target intake cam phaser angle for the i-th one of the N control loops, ICPRef is the reference intake cam phaser angle for the i-th one of the N control loops, and wIP is a weighting value associated with the relationship between the possible target intake cam phaser angle and the reference intake cam phaser angles. PTECi is a possible target exhaust cam phaser angle for the i-th one of the N control loops, ECPRef is the reference exhaust cam phaser angle for the i-th one of the N control loops, and wEP is a weighting value associated with the relationship between the possible target exhaust cam phaser angle and the reference exhaust cam phaser angles.

PSi is a possible target spark timing for the i-th one of the N control loops, SRef is the reference spark timing for the i-th one of the N control loops, and wS is a weighting value associated with the relationship between the possible target spark timings and the reference spark timings. PNi is a possible number of cylinders for the i-th one of the N control loops, NRef is the reference number of cylinders for the i-th one of the N control loops, and wN is a weighting value associated with the relationship between the possible number of cylinders and the reference number of cylinders. PFi is possible fueling for the i-th one of the N control loops, FRef is the reference fueling for the i-th one of the N control loops, and wF is a weighting value associated with the relationship between the possible fueling and the reference fueling.

ρ is a weighting value associated with satisfaction of the output constraints 352. ϵ is a variable that the cost module 332 may set based on whether the output constraints 352 will be satisfied. For example, the cost module 332 may increase E when a predicted parameter is greater than or less than the corresponding minimum or maximum value (e.g., by at least a predetermined amount). The cost module 332 may set E to zero when all of the output constraints 352 are satisfied. ρ may be greater than the weighting value wT, the weighting value wFE, the weighting value wNVH, and the other weighting values (wTV, wWG, wEGR, wIP, wEP, wS, wN, wF) such that the cost determined for a possible sequence will be large if one or more of the output constraints 352 are not satisfied.

This may help prevent selection of a possible sequence where one or more of the output constraints 352 are not satisfied.

The weighting value wT may be greater than the weighting value wFE, the weighting value wNVH, and the weighting values wTV, wWG, wEGR, wIP, wEP, wS, wN, and wF. In this manner, the relationship between the relationship between the predicted engine torque and the base torque request 308 have a larger effect on the cost and, therefore, the selection of one of the possible sequences as discussed further below. The cost increases as the difference between the predicted engine torque and the base torque request 308 increases and vice versa.

The weighting value wFE and the weighting value wNVH may be greater than the weighting values wTV, wWG, wEGR, wIP, wEP, wS, wN, and wF. In this manner, the relationship between the predicted fuel efficiency and the predetermined maximum fuel efficiency and the relationship between the predicted NVH and the predetermined NVH have larger effects on the cost. For example only, the predetermined minimum NVH may be zero or another suitable value, and the predetermined maximum fuel efficiency may be a value indicative of a greatest possible fuel efficiency.

As the selection module 344 may select the one of the possible sequences having the lowest cost, the selection module 344 may select the one of the possible sequences that best achieves the base torque request 308 while minimizing the NVH and maximizing the fuel efficiency.

The weighting values wTV, wWG, wEGR, wIP, wEP, wS, wN, and wF may be less than all of the other weighting values. In this manner, during steady-state operation, the target values 230-244 may settle near or at the reference values 356, respectively. During transient operation or when a change in the base torque request 308 is anticipated, however, the MPC module 312 may adjust the target values 230-244 away from the reference values 356 in order to more closely track the base torque request 308, minimize the NVH, and maximize the fuel efficiency while satisfying the actuator constraints 348 and the output constraints 352.

As discussed above, the cost value is determined based on the relationships between the predicted torques for future ones of the N control loops and the base torque requests for those ones of the N control loops, respectively. The base torque request 308 is generated for the next one of the N control loops (i.e., for i=1).

Referring back to FIG. 2, a future request module 380 sets the base torque requests for the other ones of the N control loops (i.e., for i=2, . . . N). These base torque requests (for i=2, . . . N) will be referred to as future torque requests 384, and correspond to expected values of the base torque request 308 generated for those future control loops. As discussed above, the future torque requests 384 are considered in determining the costs of the possible sequences.

When the future request module 380 determines that the base torque request 308 will remain approximately constant during the N control loops, the future request module 380 may set the future torque requests 384 equal to the base torque request 308. The future request module 380 may set the future torque requests 384 to greater than the base torque request 308 or to less than the base torque request 308 under some circumstances.

For example, as discussed above, the driver torque module 202 applies one or more filters to generate the driver torque request 204. The driver torque request 204 therefore may not change as rapidly as, for example, the accelerator pedal position. The future request module 380 may set the future torque requests 384 to greater than the base torque request 308 when the accelerator pedal position increases in anticipation of the increase in the driver torque request 204 that will occur later in response to the accelerator pedal increase. Conversely, the future request module 380 may set the future torque requests 384 to less than the base torque request 308 when the accelerator pedal position decreases since the driver torque request 204 will decrease later in response to the accelerator pedal decrease.

The future request module 380 may set the future torque requests 384 to greater than the base torque request 308 when the driver has selected a sport mode of operation of the vehicle. This may be done to enable the engine 102 to more quickly respond to the driver depressing the accelerator pedal and increasing the accelerator pedal position.

Another example is the future request module 380 may set the future torque requests 384 to greater than or less than the base torque request 308 for gear shifts of the transmission. For example, the future request module 380 may set the future torque requests 384 to greater than the base torque request 308 for an upshift of the transmission, and may set the future torque requests 384 to less than the base torque request for a downshift of the transmission. The transmission control module 194 may indicate upcoming gear shifts to the ECM 114.

Another example is the future request module 380 may set the future torque requests 384 to greater than or less than the base torque request 308 based on electric motor usage. For example, the future request module 380 may set the future torque requests 384 to greater than the base torque request 308 when torque produced by the electric motor 198 to supplement the engine 102 will decrease. The future torque request module 380 may set the future torque requests 384 to less than the base torque request when torque produced by the electric motor 198 to supplement the engine 102 will increase.

Other examples include the future request module 380 may set the future torque requests 384 to greater than the base torque request 308 for a load on the engine 102 and/or when a reserve torque is requested. A reserves/loads module 388 may request an increase in the future torque requests 384 to create a torque reserve and/or to compensate for one or more loads on the engine 102.

A torque reserve can be created by increasing the APC of the engine 102 to greater than an APC that can achieve the base torque request 308 using an optimal spark timing. The spark timing can be retarded from the optimal spark timing to achieve the base torque request 308 although, at the APC, the engine 102 could produce a greater amount of torque.

For example only, the air/fuel ratio of the engine and/or the mass air flow may be directly varied, such as by diagnostic intrusive equivalence ratio testing and/or new engine purging. Before beginning these processes, the reserves/loads module 388 may request an increase in the future torque requests 384 (above the base torque request 308) to quickly offset decreases in engine output torque that result from leaning the air/fuel mixture during these processes.

The reserves/loads module 388 may also create or increase a torque reserve in anticipation of a future load, such as power steering pump operation or engagement of an air conditioning (NC) compressor clutch. The reserves/loads module 388 may request an increase in the future torque requests 384 (above the base torque request 308) for engagement of the NC compressor clutch when the driver first requests air conditioning. The engine 102 is therefore prepared to create the extra torque needed when the A/C compressor clutch engages.

Based on the future torque requests 384, the MPC module 312 will select a possible sequence that, while achieving the base torque request 308, prepares the engine 102 to increase or decrease the engine torque output when the base torque request 308 increases or decreases. More specifically, possible sequences that will allow the engine 102 to more closely achieve the future torque requests 384 will have lower costs than other possible sequences. As such, the MPC module 312 will select a possible sequence that, while achieving the base torque request 308, prepares the engine 102 to achieve the future torque requests 384. This may allow the engine 102 to more quickly respond to the changes in the base torque request 308 when they occur.

Figure 4:
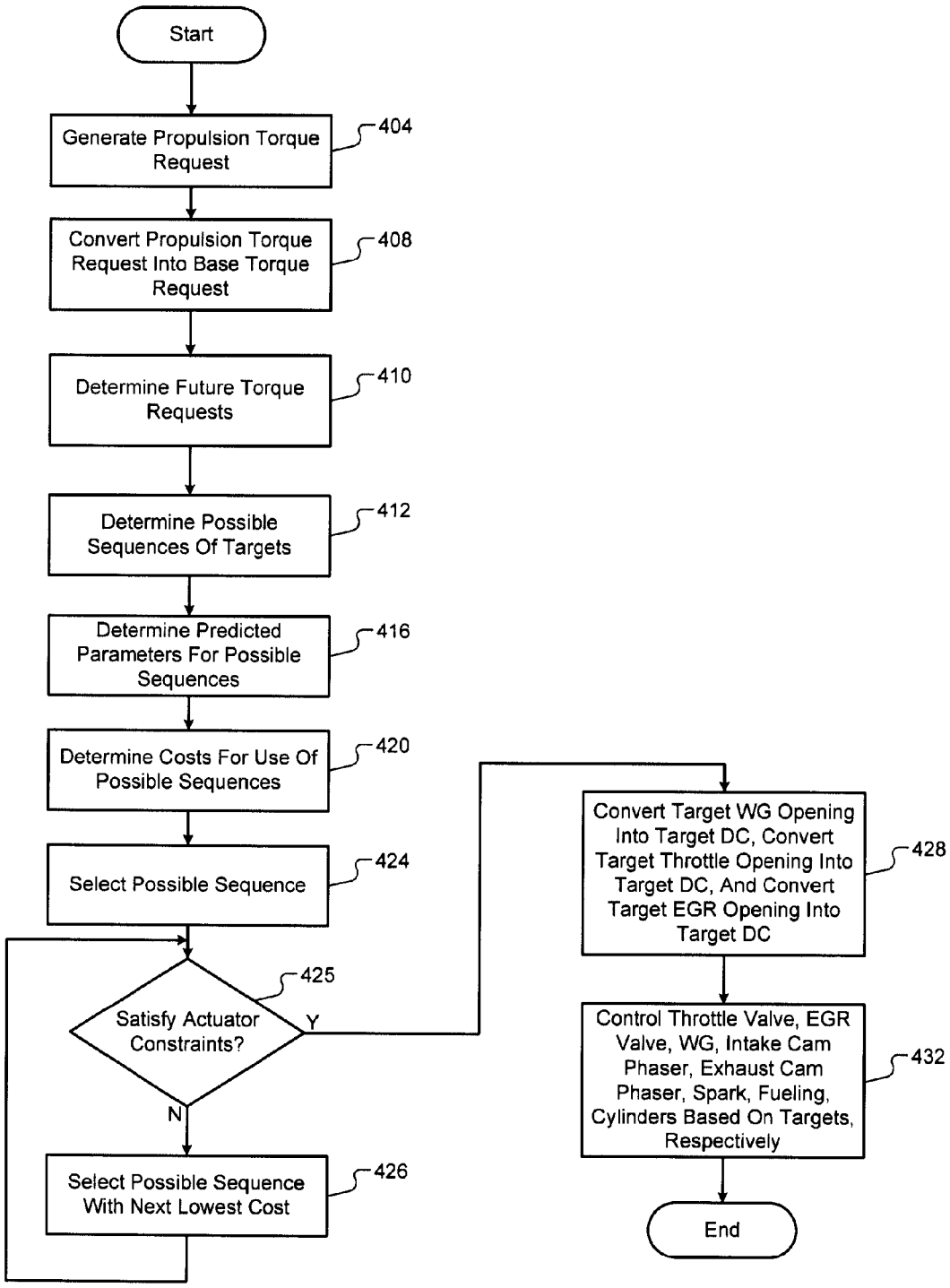
FIG. 4 is a flowchart depicting an example method of controlling a throttle valve, intake and exhaust valve phasing, a wastegate, an exhaust gas recirculation (EGR) valve, spark timing, and fueling using model predictive control according to the present disclosure.

Referring now to FIG. 4, a flowchart depicting an example method of controlling the throttle valve 112, the intake cam phaser 148, the exhaust cam phaser 150, the wastegate 162 (and therefore the turbocharger), the EGR valve 170, spark timing, fueling, and number of cylinders activated/deactivated using MPC (model predictive control) is presented. Control may begin with 404 where the torque requesting module 224 determines the propulsion torque request 218.

At 408, the torque conversion module 304 converts the propulsion torque request 218 into the base torque request 308 or into another suitable type of torque for use by the MPC module 312. The future request module 380 determines the future torque requests 384 at 410 based on one or more expected future changes in the base torque request 308. The sequence determination module 316 determines possible sequences of the target values 230-244 at 412.

At 416, the prediction module 323 determines the predicted parameters for each of the possible sequences of target values. The prediction module 323 determines the predicted parameters for the possible sequences based on the model 324 of the engine 102, the exogenous inputs 328, and the feedback inputs 330. More specifically, based on a possible sequence of the target values 230-244, the exogenous inputs 328, and the feedback inputs 330, using the model 324, the prediction module 323 generates a sequence of N predicted torques of the engine 102 for the N control loops, a sequence of N predicted fuel efficiency values for the N control loops, and a sequence of N predicted NVH values for the N control loops.

The cost module 332 determines the costs for the possible sequences, respectively, at 420. For example only, the cost module 332 may determine the cost for a possible sequence of the target values 230-244 based on the equation:

$$\text{Cost}=\Sigma_{i=1}^{N}\rho\epsilon^2+\|wT^*(TP_i-BTR_i)\|^2+\|wF^*(FEP_i-MaxFE)\|^2+\|wNVH^*(FEP_i-MinNVH)\|^2,$$

or the equation:

$$\text{Cost}=\Sigma_{i=1}^{N}\rho\epsilon^2+\|wT^*(TP_i-BTR_i)\|^2+\|wF^*(FEP_i-MaxFE)\|^2+\|wNVH^*(FEP_i-MinNVH)\|^2+\|wTV^*(PTTOi-TORefi)\|^2+\|wWG^*(PTWGOi-EGORefi)\|^2+\|wEGR^*(PTEGROi-EGRORefi)\|^2+\|wIP^*(PTICPi-ICPRefi)\|^2+\|wEP^*(PTECPi-ECPRefi)\|^2+\|wS^*(PSi-SRefi)\|^2+\|wN^*(PNi-NRefi)\|^2+\|wF^*(PFi-FRefi)\|^2$$

subject to the actuator constraints 348 and the output constraints 352, as discussed above.

The selection module 344 selects one of the possible sequences of the target values 230-244 based on the costs of the possible sequences, respectively, at 424. For example, the selection module 344 may select the one of the possible sequences having the lowest cost. The selection module 344 may therefore select the one of the possible sequences that best achieves the base torque request 308 and the future torque requests 384 while maximizing the fuel efficiency and minimizing the NVH. Instead of or in addition to determining possible sequences of the target values at 402 and determining the cost of each of the sequences at 420, the MPC module 312 may identify a sequence of possible target values having the lowest cost using convex optimization techniques as discussed above.

The MPC module 312 may determine whether the selected one of the possible sequences satisfies the actuator constraints 348 at 425. If 425 is true, control may continue with 428. If 425 is false, the MPC module 312 may select another one of the possible sequences with the next lowest cost at 426, and control may return to 425. In this manner, the sequence with the lowest cost that satisfies the actuator constraints 348 will be used.

At 428, the first conversion module 248 converts the target wastegate opening area 230 into the target duty cycle 250 to be applied to the wastegate 162, the second conversion module 252 converts the target throttle opening area 232 into the target duty cycle 254 to be applied to the throttle valve 112. The third conversion module 256 also converts the target EGR opening area 234 into the target duty cycle 258 to be applied to the EGR valve 170 at 428. The fourth conversion module may also convert the target intake and exhaust cam phaser angles 236 and 238 into the target intake and exhaust duty cycles to be applied to the intake and exhaust cam phasers 148 and 150, respectively. If a value other than spark timing is determined, such as a target torque decrease or a target combustion phasing, the spark timing may be determined based on that value at 428.

At 432, the throttle actuator module 116 controls the throttle valve 112 to achieve the target throttle opening area 232, and the phaser actuator module 158 controls the intake and exhaust cam phasers 148 and 150 to achieve the target intake and exhaust cam phaser angles 236 and 238, respectively. For example, the throttle actuator module 116 may apply a signal to the throttle valve 112 at the target duty cycle 254 to achieve the target throttle opening area 232.

Also at 432, the EGR actuator module 172 controls the EGR valve 170 to achieve the target EGR opening area 234, and the boost actuator module 164 controls the wastegate 162 to achieve the target wastegate opening area 230. For example, the EGR actuator module 172 may apply a signal to the EGR valve 170 at the target duty cycle 258 to achieve the target EGR opening area 234, and the boost actuator module 164 may apply a signal to the wastegate 162 at the target duty cycle 250 to achieve the target wastegate opening area 230. Also at 432, the spark actuator module 126 controls the spark timing based on the target spark timing 240, the cylinder actuator module 120 controls cylinder activation and deactivation based on the target number of cylinders 242, and the fuel actuator module 124 controls fueling based on the target fueling parameters 244. While FIG. 4 is shown as ending after 432, FIG. 4 may be illustrative of one control loop, and control loops may be executed at a predetermined rate.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. An engine control system of a vehicle, comprising:

a prediction module that, based on a set of possible target values for M future times and a model of an engine, determines predicted torques of the engine for the M future times, respectively, wherein M is an integer greater than one;

a cost module that determines a cost for the set of possible target values based on comparisons of the predicted torques for the M future times with engine torque requests for the M future times, respectively;

a selection module that, based on the cost, selects the set of possible target values from a group including the set of possible target values and N other sets of possible target values, wherein N is an integer greater than zero, and that sets target values based on the selected set of possible target values; and an actuator module that controls an engine actuator based on a first one of the target values.

2. The engine control system of claim 1 wherein:

based on the set of possible target and the model of the engine, the prediction module further determines a predicted fuel efficiency of the engine; and the cost module determines the cost for the set of possible target values further based on a comparison of the predicted fuel efficiency with a predetermined maximum fuel efficiency.

3. The engine control system of claim 1 wherein:

based on the set of possible target and the model of the engine, the prediction module further determines a predicted noise, vibration, and harshness (NVH) value; and the cost module determines the cost for the set of possible target values further based on a comparison of the predicted NVH value with a predetermined NVH value.

4. The engine control system of claim 1 further comprising a future request module that sets at least one of the engine torque requests for the M future times based on a gear shift of a transmission.

5. The engine control system of claim 1 further comprising a future request module that sets at least one of the engine torque requests for the M future times based on a change in an accelerator pedal position.

6. The engine control system of claim 1 further comprising a future request module that sets at least one of the engine torque requests for the M future times based on a change in a load on the engine.

7. The engine control system of claim 1 further comprising a future request module that sets at least one of the engine torque requests for the M future times based on a change in torque of an electric motor.

8. The engine control system of claim 1 further comprising a future request module that sets at least one of the engine torque requests for the M future times when a sport mode of operation is selected for the vehicle.

9. The engine control system of claim 1 wherein the selection module selects the set of possible target values from the group based on the cost being less than costs of the N other sets of possible target values, respectively.

10. The engine control system of claim 1 further comprising:

a boost actuator module that controls opening of a wastegate of a turbocharger based on a second one of the target values;

an exhaust gas recirculation (EGR) actuator module that controls opening of an EGR valve based on a third one of the target values;

a phaser actuator module that controls intake and exhaust valve phasing based on fourth and fifth ones of the target values, respectively;

a spark actuator module that controls spark timing based on a sixth one of the target values; and a fuel actuator module that controls fueling based on a seventh one of the target values, wherein the actuator module controls the opening of a throttle valve based on the one of the target values.

11. An engine control method for a vehicle, comprising:

based on a set of possible target values for M future times and a model of an engine, determining predicted torques of the engine for the M future times, respectively, wherein M is an integer greater than one;

determining a cost for the set of possible target values based on comparisons of the predicted torques for the M future times with engine torque requests for the M future times, respectively;

based on the cost, selecting the set of possible target values from a group including the set of possible target values and N other sets of possible target values, wherein N is an integer greater than zero;

setting target values based on the selected set of possible target values; and controlling an engine actuator based on a first one of the target values.

12. The engine control method of claim 11 further comprising:

based on the set of possible target and the model of the engine, determining a predicted fuel efficiency of the engine; and determining the cost for the set of possible target values further based on a comparison of the predicted fuel efficiency with a predetermined maximum fuel efficiency.

13. The engine control method of claim 11 further comprising:

based on the set of possible target and the model of the engine, determining a predicted noise, vibration, and harshness (NVH) value; and determining the cost for the set of possible target values further based on a comparison of the predicted NVH value with a predetermined NVH value.

14. The engine control method of claim 11 further comprising setting at least one of the engine torque requests for the M future times based on a gear shift of a transmission.

15. The engine control method of claim 11 further comprising setting at least one of the engine torque requests for the M future times based on a change in an accelerator pedal position.

16. The engine control method of claim 11 further comprising setting at least one of the engine torque requests for the M future times based on a change in a load on the engine.

17. The engine control method of claim 11 further comprising setting at least one of the engine torque requests for the M future times based on a change in torque of an electric motor.

18. The engine control method of claim 11 further comprising setting at least one of the engine torque requests for the M future times when a sport mode of operation is selected for the vehicle.

19. The engine control method of claim 11 further comprising selecting the set of possible target values from the group based on the cost being less than costs of the N other sets of possible target values, respectively.

20. The engine control method of claim 11 further comprising:

controlling opening of a wastegate of a turbocharger based on a second one of the target values;

controlling opening of an exhaust gas recirculation (EGR) valve based on a third one of the target values;

controlling intake and exhaust valve phasing based on fourth and fifth ones of the target values, respectively;

controlling spark timing based on a sixth one of the target values; and controlling fueling based on a seventh one of the target values, wherein the engine actuator is a throttle valve.

* * * * *